United States Patent [19]

De Leeuw et al.

[11] Patent Number: 4,859,902

[45] Date of Patent: Aug. 22, 1989

[54] METHOD OF CHANGING THE CHROMATICITY OF A CATHODOLUMINESCENT PHOSPHOR, COLOUR CATHODE RAY TUBE INCORPORATING THE PHOSPHOR, AND PROJECTION TELEVISION USING SAME

[75] Inventors: Dagobert M. De Leeuw; Dirk B. M. Klaassen; Cornelis A. H. A. Mutsaers, all of Eindhoven, Netherlands

[73] Assignee: U.S. Philips Corporation, New York, N.Y.

[21] Appl. No.: 102,988

[22] Filed: Sep. 30, 1987

[30] Foreign Application Priority Data

Oct. 3, 1986 [GB] United Kingdom ..... 8623822

[51] Int. Cl.[4] ..... H01J 29/89

[52] U.S. Cl. ..... 313/474; 313/467; 313/473; 313/478; 350/1.6; 358/253

[58] Field of Search ..... 313/461, 473, 474, 478, 313/467; 358/250, 253; 350/1.6, 313

[56] References Cited

U.S. PATENT DOCUMENTS

| | | | |
|---|---|---|---|
| 3,742,277 | 6/1973 | Peters | 313/467 |
| 4,634,926 | 1/1987 | Vriens et al. | 313/474 |
| 4,647,812 | 3/1987 | Vriens et al. | 313/474 |
| 4,683,398 | 7/1987 | Vriens et al. | 313/474 |

FOREIGN PATENT DOCUMENTS

| | | | |
|---|---|---|---|
| 170320 | 2/1986 | European Pat. Off. | 313/474 |
| 2920830 | 11/1979 | Fed. Rep. of Germany | 313/474 |
| 737223 | 2/1970 | France | 313/467 |
| 2176048 | 12/1986 | United Kingdom | 313/474 |

OTHER PUBLICATIONS

EBU Standard for Chromaticity Tolerances for Studio Monitors, EBU Technical Center, Techn. 3213-E, Brussels, Aug. 1975, pp. 1-5.

*Primary Examiner*—Donald J. Yusko
*Assistant Examiner*—Michael Horabik
*Attorney, Agent, or Firm*—John C. Fox

[57] ABSTRACT

Phosphors used in colour cathode ray tubes, particularly but not exclusively projection television tubes, have colour point standards or chromaticities modified to conform to European Broadcasting Union (EBU) standards by disposing an interference filter in the light-path from the phosphor, for example, between the phosphor and the faceplate, which has a peak gain greater than unity over a selected part of the frequency spectrum. As a result, an efficient broadband phosphor can be employed to obtain the desired chromaticity and thereby increase the white-D luminance of projection television systems.

8 Claims, 4 Drawing Sheets

METHOD OF CHANGING THE CHROMATICITY OF A CATHODOLUMINESCENT PHOSPHOR, COLOUR CATHODE RAY TUBE INCORPORATING THE PHOSPHOR, AND PROJECTION TELEVISION USING SAME

BACKGROUND OF THE INVENTION

The present invention relates to a colour cathode ray tube, particularly, but not exclusively, to a blue light emitting cathode ray tube used in a projection television (PTV) system.

Colour projection television systems normally comprise three cathode ray tubes emitting blue, green and red light, respectively. This light is mixed to produce a coloured image at a viewing screen. In forming the coloured image a number of factors have to be taken into account, these factors include chromaticity, brightness, efficiency, deterioration of the radiant efficiency of the phosphor under electron bombardment, thermal quenching at high operating temperatures, and the construction of an operative system embodying the projection television cathode ray tubes. For good colour reproduction it is important to put the chromaticities of the primary emission colours of the phosphors in the display tube or tubes (in PTV systems) as near to the corners of the CIE chromaticity diagram as possible because it is impossible to produce colours outside the triangle formed by the chromaticities of the primaries. In practical systems, the system designers endeavour to conform to the industry standards for chromaticity. There is a reference point in the known CIE colour triangle referred to as the white-D. It is desirable that the white-D luminance is as high as possible consistent with good chromaticity of the primaries which fulfil the industry standard specification. The white-D brightness of PTV systems at the moment is determined by the output of the blue emitting component ZnS:Ag (silver activated zinc sulphide). The white-D capability (or figure of merit) of blue emitting phosphors is given by $$\frac{\eta L}{y} = \eta_{CR} \cdot \frac{L}{y}$$

where $\eta_{CR}$ is the energy efficiency of the phosphor under cathode-ray (CR) excitation, L is the lumen equivalent of the spectral emission, y is the y-coordinate of the chromaticity, and $\eta_L$ is the so-called lumen efficiency of the phosphor (Lumens out/Watt input).

The main disadvantage of ZnS:AG is that its efficiency decreases with increasing beam current. In consequence the efficiency of ZnS:Ag at high beam currents is low and therefore limits the white-D luminance. Although other blue light emitting phosphors are known, the chromaticities of their emission are not acceptable because the y colour coordinate is either too high, which means that it is not possible to obtain a full range of colours, or too low so that the amount of blue light required is too critical to adjust and operate a PTV system.

An object of the present invention is to alter considerably the chromaticity of phosphors, especially the blue phosphor, as viewed in projection cathode ray tubes, without decreasing the white-D capability.

SUMMARY OF THE INVENTION

According to one aspect of the present invention there is provided a method of changing the chromaticity without losing the white-D capability of a cathodoluminescent phosphor having a broadband emission spectrum including a desired narrowband of interest, the method comprising disposing an interference filter in the light path from the phosphor, the interference filter having a characteristic which has a peak gain greater than unity over the desired narrow band so that the filtered spectral emission has modified colour coordinates.

The present invention is based on the recognition of the fact that an interference filter can provide gain, that is, more photons in the forward direction in its passband, and attenuation outside its passband so that a stable broadband cathode ray tube phosphor which previously was unsuitable can be used to produce a desired output, that is, one having a desired chromaticity and efficiency which will lead to an increase in the white-D luminance. Thus, by means of the present invention the phosphors chromaticities can be brought into a specific region of the CIE diagram, for instance the EBU (European Broadcasting Union) specification.

The use of short wave pass interference filters to enhance light output of projection television tubes is known for example from published European Patent Application No. 0.170.320. Additionally the use of interference filters to reduce halo is known from published European Patent Application No. 0.148.530 now abandoned. However as far as is known there is no disclosure of the use of interference filters to adjust the chromaticity of a cathodoluminescent phosphor so that its colour point can conform to a standard and in so doing have the possibility of increasing the white-D capability. The use of interference filters in this manner will simultaneously provide halo suppression.

According to a second aspect of the present invention there is provided a cathode ray tube comprising an envelope including an optically transparent faceplate, a cathodoluminescent phosphor having a broadband emission spectrum including a desired narrowband of interest, carried by the faceplate, and an interference filter mounted in the light path from the phosphor, the filter having a characteristic which has a peak gain greater than unity over the desired narrowband so that the filtered spectral emission has a modified chromaticity.

In the case of the phosphor being provided inside the cathode ray tube, the interference filter may be provided either on the inside or the outside of the faceplate of the tube but from the point of view of avoiding abrasion and deterioration due to other sources it is better to provide the filter on the inside surface of the faceplate.

The present invention further provides a projection television system comprising cathode ray tubes luminescing in red, green and blue, wherein at least the blue luminescing tube comprises a cathodoluminescent phosphor having a broadband emission spectrum including a desired narrowband of interest, carried by a faceplate of the tube, and an interference filter mounted in the light path from the phosphor, the filter having a characteristic which has a peak gain greater than unity over the desired narrowband so that the filtered spectral emission has a modified chromaticity.

BRIEF DESCRIPTION OF THE DRAWINGS

The present invention will now be described, by way of example, with reference to the accompanying drawings, wherein.

DESCRIPTION OF THE PREFERRED EMBODIMENTS

Figure 1:
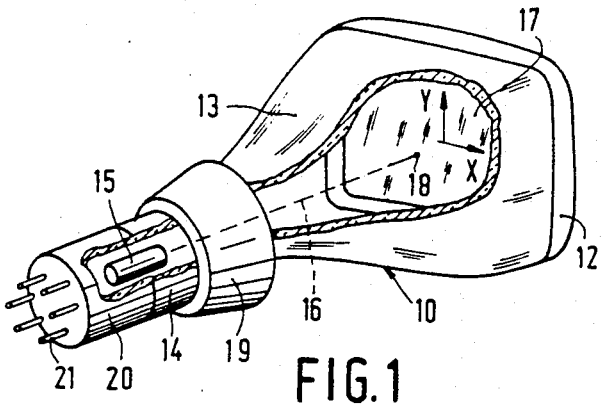
FIG. 1 is a diagrammatic, perspective view of a projection television cathode ray tube with a portion of the envelope broken away.

The projection cathode ray tube 10 shown in FIG. 1 comprises a glass envelope formed by an optically transparent faceplate 12, a cone 13 and a neck 14. An electron gun 15 is provided in the neck 14 and generates an electron beam 16 which produces a spot 18 on a cathodoluminescent screen structure 17 provided on the faceplate 12. The spot 18 is deflected in mutually perpendicular directions X and Y by deflection coils 19 mounted at the neck-cone transition of the envelope. Electrical connections to the interior of the envelope are via pins 21 in a cap 20.

Figure 2:
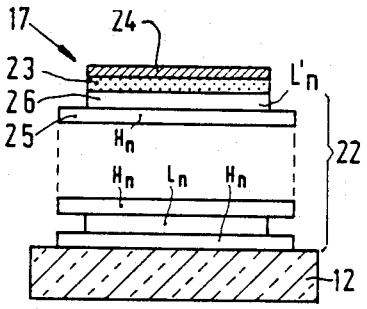
FIG. 2 is a diagrammatic cross-sectional view through a multilayer interference filter.

Referring to FIG. 2, the faceplate/screen structure comprises the faceplate 12, which may be flat or curved, a multilayer interference filter 22 applied to the interior surface of the faceplate, a cathodoluminescent screen material 23 applied to the filter 22 and an aluminium film 24 covering the screen material 23.

The multilayer interference filter 22 comprises between 14 and 30 layers, with alternate layers comprising materials having high ($H_n$) and low ($L_n$) refractive indices (n). The optical thickness of each of the layers is $n \times d$, where n is the refractive index of the material and d the actual thickness, the optical thickness for the individual layers lies between $0.2\lambda_f$ and $0.3\lambda_f$, more particularly between $0.23\lambda_f$, and $0.27\lambda_f$ with an average optical thickness throughout the stack of $0.25\lambda_f$, where $\lambda_f$ is equal to $p \times \lambda$, p being a number between 1.20 and 1.33 and $\lambda$ being the desired central wavelength selected from the spectrum emitted by the cathodoluminescent screen 23. In fabricating the filter 22 the high refractive index layer 25 furthest from the faceplate has an optical thickness in the range specified but this layer 25 may be covered by a thinner, typically $0.125\lambda_f$, terminating layer 26 having a lower ($L'_n$) refractive index. An example of such a filter comprises 20 layers, including the terminating layer, comprising $SiO_2$ (n=1.47) as the $L_n$ layers and $TiO_2$ (n=2.35) as the $H_n$ layers.

In the illustrated embodiment, the phosphor of the cathodoluminescent screen 23 comprises a suitable broadband phosphor emitting light of the required colour, for example blue, green or red. For convenience of description, reference will be made to the blue phosphor since in currently available projection television systems the widely used ZnS:Ag phosphor imposes a limit on the white-D luminance. White-D capability of a blue phosphor is defined as the ratio of lumen efficiency of the phosphor $\eta_L$ divided by the y-coordinate of the chromaticity which in turn is equal to the energy efficiency $\eta_{CR}$ multiplied by the ratio of lumen equivalent L of the spectral emission to the y-value, that is $$\frac{\eta L}{y} = \eta_{CR} \cdot \frac{L}{y}$$

Figure 3:
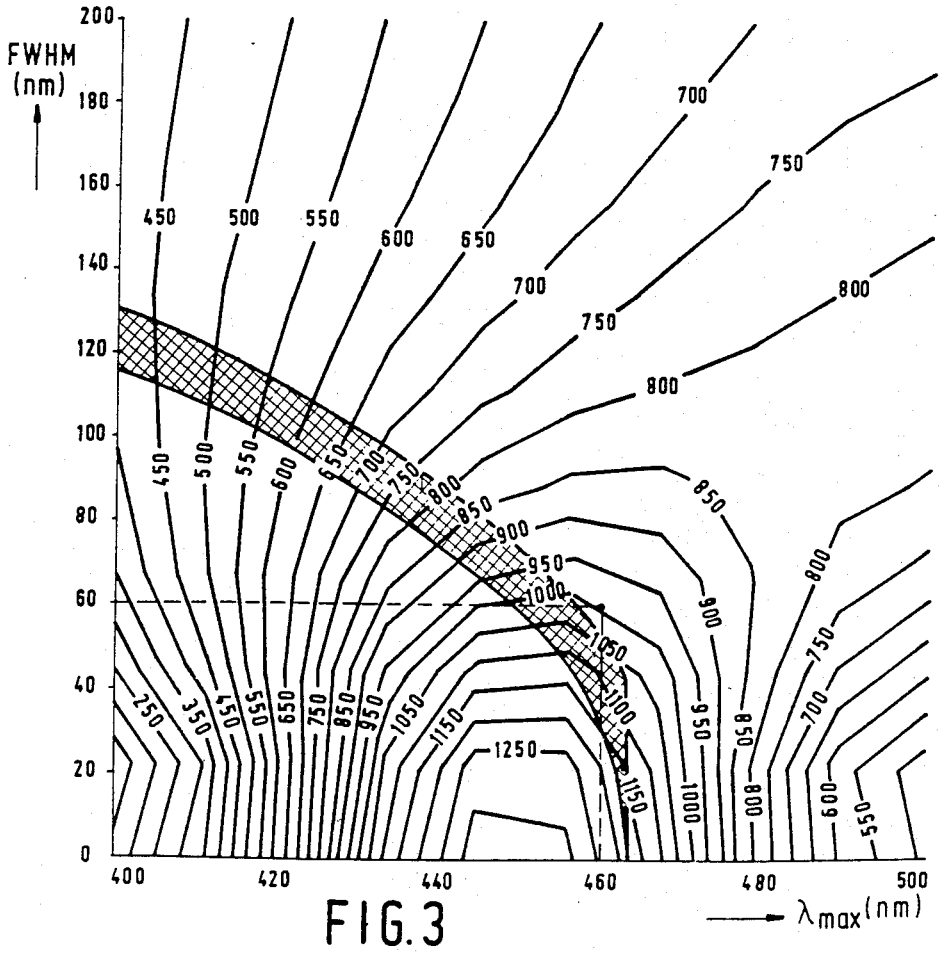
FIG. 3 is graph of calculated contour lines of L/y (the lumen equivalent of a spectral Gaussian emission divided by the y-coordinate of the chromaticity of that emission as a function of $\lambda_{max}$ (the position of the maximum of the emission) and the full width half maximum (FWHM) of that Gaussian emission.

FIG. 3 is a graph of calculated contour lines of L/y (the lumen equivalent of a spectral Gaussian emission divided by the y-coordinate of the chromaticity of that emission) as a function of $\lambda_{max}$ (the position of the maximum of the emission) and the full width half maximum of that Gaussian emission. The number applied to each line represents L/y. A value in the order of 1000 is considered typical, for example ZnS:Ag. Also indicated by cross-hatching are those Gaussian emissions whose chromaticities are within the tolerance range for the EBU specifications for blue. These tolerances are published in E.B.U. Standard for Chromaticity Tolerances for Studio Monitors, E.B.U. Technical Centre, Techn. 3213-E, Brussels, August, 1975. Since the cross-hatched area is small it means that only a few phosphors are usable and of these ZnS:Ag is the most popular blue one. However, as explained, ZnS:Ag phosphors have a disadvantage of having a low efficiency at high beam current which limits the white-D brightness obtainable in actual PTV systems.

Figure 4:
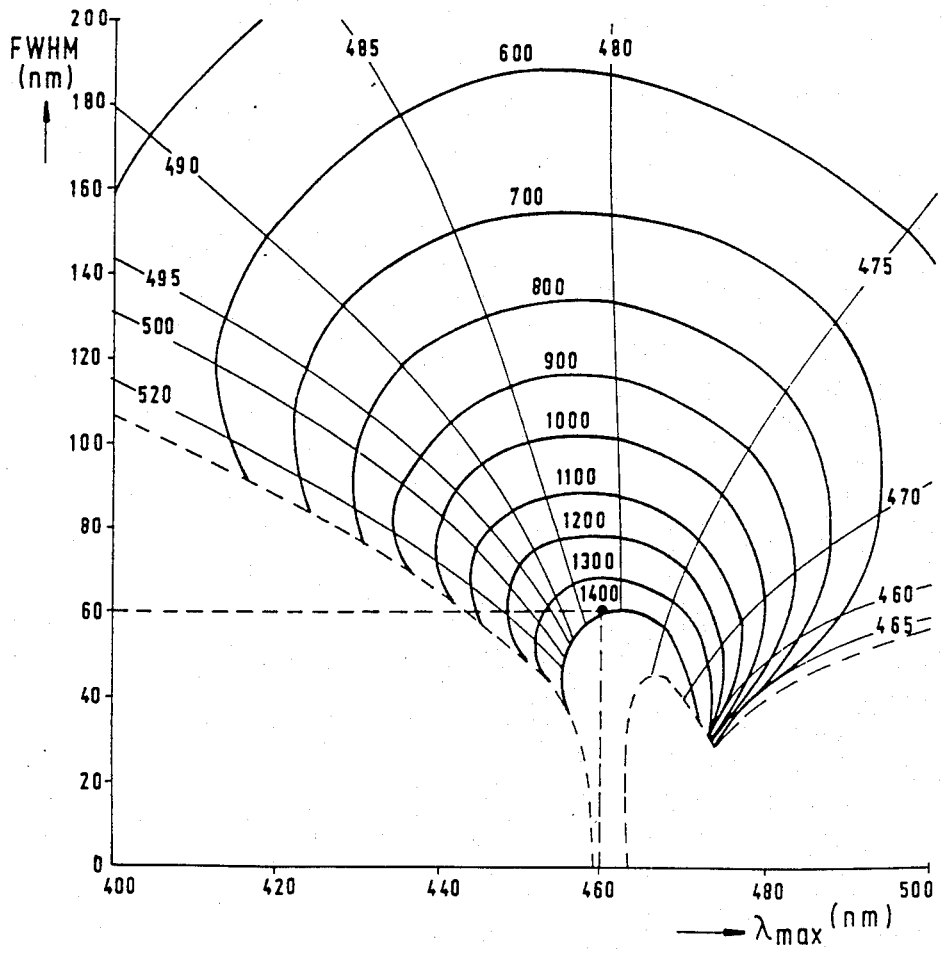
FIG. 4 is a graph of calculated continuous lines of the lumen equivalent of a filtered spectral emission divided by the y-coordinate of the chromaticity of that filtered emission multiplied by the gain in energy emitted in the forward direction using an interference filter with a broadband phosphor as a function of $\lambda_{max}$ (the position of the maximum of the unfiltered Gaussian emission) and the full width half maximum (FWHM) of the unfiltered Gaussian emission.

FIG. 4 is a graph of calculated contour lines of the lumen equivalent of a filtered spectral emission divided by the y-coordinate of the chromaticity of that filtered emission multiplied by the gain in energy emitted in the forward direction using an interference filter with a broadband phosphor as a function of $\lambda_{max}$ (the position of the maximum of the unfiltered Gaussian emission) and the full width half maximum "FWHM" of the unfiltered Gaussian emission. All the chromaticities of the emissions enclosed by the dashed lines are within the EBU specifications for the blue when an appropriate filter is applied. The value of the desired wavelength of maximum gain of said filter is indicated by the radial lines and the value of the effective lumen equivalent (values 600 to 1400) is indicated by the arcuate lines. In order to illustrate more clearly the advantage of the present invention, FIG. 5, which is a combination of FIGS. 3 and 4, illustrates the increase (in %) of L/y of the filtered emission multiplied by the energy gain in the forward direction. This Figure illustrates that there can be a slight loss, between 0 and −10%, due to the application of interference filters but generally there is a gain of up to about 30%. This figure indicates that there is a large flexibility in choosing a combinaton of a phosphor material and an interference filter to produce a chromaticity fulfilling the EBU requirements for blue (compare with the cross-hatched area in FIG. 3). Hence the chromaticity of the spectral emission of the phosphor no longer restricts the choice of material to be used.

By using an interference filter then it is possible to obtain an acceptable crhomaticity using a broadband blue phosphor, such as $Sr_2Al_6O_{11}$:Eu; $SrGa_2S_4$:Ce; $Y_2SiO_5$:Ce or (Ca,Mg)$SiO_3$:Ti, all of which, without the use of the interference filter, would be unacceptable. This means that phosphors which previously would not fulfill EBU colour point standards can be used assuming that they are satisfactory in other respects.

Figure 6:
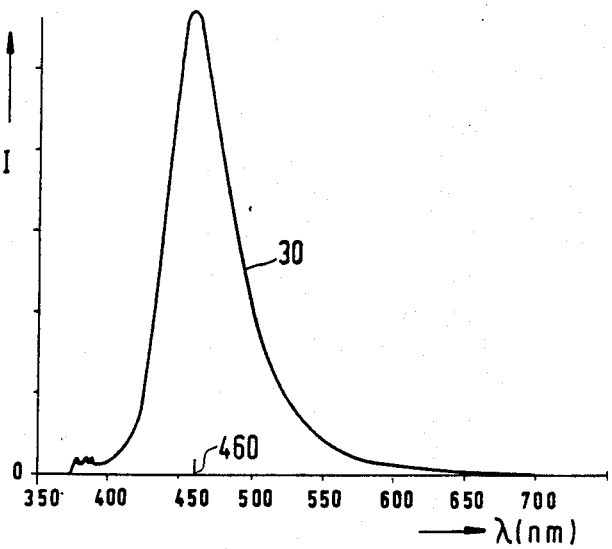
FIG. 6 is graph of Intensity (I) against wavelength ($\lambda$) of an unfiltered emission spectrum for a blue $Sr_2Al_6O_{11}$:Eu phosphor.
Figure 7:
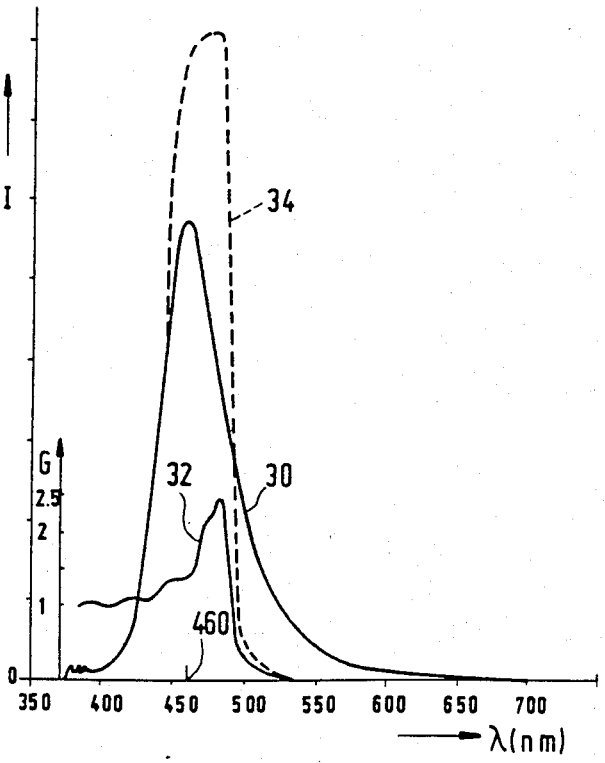
FIG. 7 shows the unfiltered emission spectrum (30) of FIG. 6, the gain characteristic (32) of an interference filter, the ordinate being referenced G for gain, and the filtered emission spectrum (34), In the drawings the same reference numerals have been used to indicate corresponding features.

In order to illustrate how this is achieved, reference is made to FIGS. 6 and 7 of the drawings. FIG. 6 shows the unfiltered emission spectrum 30 of a $Sr_2Al_6O_{11}$:Eu blue phosphor. The x-value of the chromaticity of the spectral emission is 0.147 and the y-value of the chromaticity of the spectral emission is 0.121, which is too high with respect to the EBU specifications for blue, which specify the y value to lie between 0.053 and 0.072. The value of L/y-value is 1008.

FIG. 7 shows the unfiltered emission spectrum 30, the characteristic gain curve 32 (gain G plotted against wavelength λ) of an interference filter, and in broken lines 34 the filtered emission spectrum of the phosphor.

Referring initially to the filter characteristic 32, it will be noted that for wavelengths up to about 410 nanometers the filter has a gain of the order of unity and has no effect, for wavelengths between about 410 nm and 490 nm the gain of the filter increases to a maximum of 2.5, and thereafter at wavelengths greater than 490 nm the gain drops rapidly to zero. The modified response 34 shows that the brightness in the forward direction is increased when the gain of the filter is greater than one, but decreases rapidly to zero when the gain drops below unity. The effect of using the interference filter is to reshuffle the emission spectrum so that it has a y chromaticity which is acceptable as an EBU blue. In this example the modified chromaticity is x=0.135 and y=0.058. The filter used in this example has its maximum gain at 483 nm. The positive gain of the interference filter means that there is an energy gain in the forward direction, equal to 23.5% in this example. The lumen equivalent over the y-value of the filtered emission has increased from 1000 to 1053. The white-D capability of the filtered emission of the phosphor of this example, which is expressed as L/y multiplied by the energy gain in forward direction, (see FIG. 4), amounts to 1300 (=1053×1.235). This implies an increase in white-D capability of about 29% (1300/1008) which is in good agreement with the results of model calculations as presented in FIG. 5.

Figure 5:
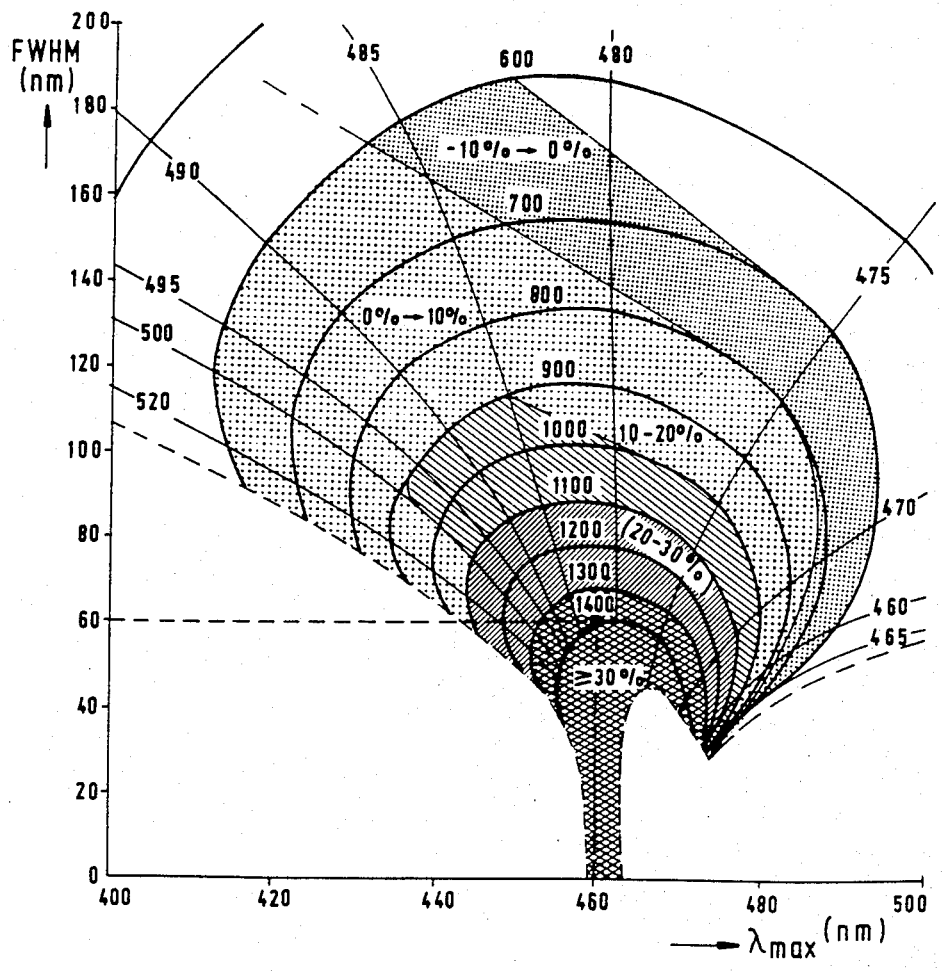
FIG. 5 is a combination of FIGS. 3 and 4 and illustrates the change in lumen equivalent divided by the y-value of the filtered emission times the gain in energy emitted in the forward direction.

In order to facilitate an understanding of how these values have been calculated, reference is made to FIGS. 3, 4 and 5. Taking $Sr_6Al_6O_{11}$:Eu as a specimen phosphor, FIG. 6 shows that its response is more or less Gaussian and that $\lambda_{max}$ is 460. If the FWHM is taken to be 60.00 nm, then in FIG. 3 these points 460, 60.00 intersect on the 1000 curve indicating that L/y is about 1000. Turning to FIG. 4, the coordinates $\lambda_{max}=460$, FWHM=60 define a point nearly on the 1400 arcuate line, indicating that L/y times gain in energy emitted in the forward direction is of the order of 1400 at a filter wavelength of maximum gain of between 480 and 485 nm. These coordinates on FIG. 5 define a point lying in the ≧30% cross-hatched zone which suggests an increase in white-D capability of greater than or equal to 30%. By way of comparison an actual example will be considered in which L/y is about 1000. A filter is used having a wavelength of maximum gain of 483 nm which gives a gain in energy such that $$L/y \times \text{Gain in energy} = 1300$$

thus giving an increase in white-D capability of 29%. This value is comparable to the calculated values.

$Y_2SiO_5$:Ce and (Ca,Mg)$SiO_3$:Ti phosphors are well-known efficient cathode-ray phosphors. However under normal circumstances they are unsuitable for use in projection television cathode ray tubes because their emission is too white. That is, their y-values of chromaticity of spectral emission are much too high. By way of comparison a tabular summary is set out below illustrating the characteristics of the phosphor materials themselves and how by using a suitable interference filter, blue light having an acceptable chromaticity can be obtained.

In this Table, "MG" signifies the filter wavelength of maximum gain.

| | | | | Gain | | |
|---|---|---|---|---|---|---|
| Phosphor | x | y | L | L/y | Energy in forward direction | η L/y |
| $Y_2SiO_5$:Ce (no filter) | 0.169 | 0.106 | 70.5 | — | — | — |
| $Y_2SiO_5$:Ce with filter MG at 500 nm | 0.144 | 0.62 | 41.8 | 1.014 | 1.025 | 1.04 |
| (Ca,Mg)$SiO_3$:Ti (no filter) | 0.170 | 0.130 | 93 | — | — | — |
| (Ca,Mg)$SiO_3$:Ti with filter MG at 485 nm | 0.139 | 0.067 | 50.9 | 1.020 | 1.063 | 1.08 |
| $SrGa_2S_4$:Ce (no filter) | 0.135 | 0.169 | 154 | — | — | — |
| $SrGa_2S_4$:Ce with filter MG at 480 nm | 0.134 | 0.060 | 63 | 1.15 | 1.08 | 1.24 |

Obviously the present invention is not restricted to producing an EBU blue phosphor, it is possible to modify chromaticities of red and green phosphors as well.

What is claimed is:

1. A method of changing the chromaticity without losing the white D-capability of the emission of a cathodoluminescent phosphor having a broadband emission spectrum, said emission spectrum having a chromaticity outside an acceptable range for color television, the method comprising disposing an interference filter in the light path from the phosphor, the gain of said interference filter being larger than unity over a narrow band around a wavelength of maximum gain, of order unity for wavelengths smaller than the narrow band and decreasing to zero for wavelengths larger than the narrow band, said narrow band being positioned so that the filtered broad band emission has a chromaticity acceptable for color television.

2. A method as claimed in claim 1, characterized in that the cathodoluminescent phosphor is a blue emitting phosphor.

3. A cathode ray tube comprising an envelope including an optically transparent faceplate, a cathodoluminescent phosphor carried by the faceplate having a broadband emission spectrum around a wavelength of maximum emission, said emission spectrum having a chromaticity outside an acceptable range for color television, and an interference filter mounted in the lightpath from the phosphor, the gain of said interference filter being larger than unity over a narrow band around a wavelength of maximum gain, of order unity for wavelengths smaller than the narrow band and decreasing to zero for wavelengths larger than the narrow band, said narrow band being positioned so that the filtered broad band emission has a chromaticity acceptable for color television.

4. A cathode ray tube as claimed in claim 3, characterized in that the cathodoluminescent phosphor is a blue emitting phosphor.

5. A cathode ray tube as claimed in claim 4, characterized in that the phosphor is $Y_2SiO_5$:Ce and the wavelength of maximum gain is 500 nm.

6. A cathode ray tube as claimed in claim 4, characterized in that the phosphor is (Ca,Mg)$SiO_3$:Ti and the wavelength of maximum gain is 485 nm.

7. A cathode ray tube as claimed in claim 4, characterized in that the phosphor is $SrGa_2S_4$:Ce and the wavelength of maximum gain is 480 nm.

8. A cathode ray tube as claimed in claim 3, characterized in that the interference filter comprises between 14 and 30 layers formed by alternating high and low refractive index layers, each individual layer having an optical thickness lying between $0.2\lambda_f$ and $0.3\lambda_f$ with an average optical thickness of $0.25\lambda_f$, where $\lambda_f$ is equal to p times the wavelengths of maximum gain, p being a number between 1.2 and 1.33.

* * * * *